US008800772B2

(12) United States Patent
Sun

(10) Patent No.: US 8,800,772 B2
(45) Date of Patent: Aug. 12, 2014

(54) INDIVIDUALLY ATTACHED DISPOSABLE THREADS ON THREAD FRAMES FOR USE WITH EPILATION OR THREADER DEVICE

(76) Inventor: Anita Schu-Chiam Shyun Sun, Los Angeles, CA (US)

( * ) Notice: Subject to any disclaimer, the term of this patent is extended or adjusted under 35 U.S.C. 154(b) by 208 days.

(21) Appl. No.: 12/697,050

(22) Filed: Jan. 29, 2010

(65) Prior Publication Data

US 2010/0187152 A1 Jul. 29, 2010

Related U.S. Application Data

(60) Provisional application No. 61/148,128, filed on Jan. 29, 2009.

(51) Int. Cl.

| | |
|---|---|
| ***B65D 85/00*** | (2006.01) |
| ***B23P 11/00*** | (2006.01) |
| ***A45D 26/00*** | (2006.01) |
| ***A61B 17/50*** | (2006.01) |

(52) U.S. Cl.
USPC ..... 206/581; 206/388

(58) Field of Classification Search
USPC ..... 206/388, 581, 63.3, 63.5, 380, 575; 139/29–34
See application file for complete search history.

(56) References Cited

U.S. PATENT DOCUMENTS

| | | | | |
|---|---|---|---|---|
| 616,814 | A * | 12/1898 | Sutphin | 206/388 |
| 649,495 | A * | 5/1900 | Sweeney | 206/388 |
| 1,545,730 | A * | 7/1925 | Benson | 206/388 |
| 5,249,672 | A * | 10/1993 | Brown et al. | 206/63.3 |
| 5,386,912 | A * | 2/1995 | Holzwarth et al. | 206/63.3 |
| 6,283,297 | B1 * | 9/2001 | Mosley | 206/575 |
| 2009/0293982 | A1 * | 12/2009 | Skaflestad | 139/34 |

* cited by examiner

*Primary Examiner* — Andrew Perreault
(74) *Attorney, Agent, or Firm* — Adli Law Group P.C.

(57) ABSTRACT

A method of using individually attached, disposable thread pieces from thread frames in conjunction with an epilation device, including providing a first thread frame holding a plurality of individually attached thread pieces of a variable length and thickness; providing a second thread frame holding a plurality of individually attached thread pieces of a variable length and thickness, wherein the thread pieces of the first frame are of a longer length than the thread pieces of the second frame; detaching at least one thread piece from the first thread frame and at least one thread piece from the second thread frame; and securing each thread piece from the first and second thread frames onto an epilation or threader device. An apparatus of a plurality of individually attached, disposable thread pieces secured by a first thread frame and a second thread frame in a straightened orientation for use with an epilation device.

15 Claims, 12 Drawing Sheets

INDIVIDUALLY ATTACHED DISPOSABLE THREADS ON THREAD FRAMES FOR USE WITH EPILATION OR THREADER DEVICE

CROSS-REFERENCE TO RELATED APPLICATIONS

This application claims the benefit of U.S. Provisional Patent Application No. 61/148,128 filed Jan. 29, 2009 and entitled "Individually Attached Disposable Threads on Thread Frames for Use with Epilation or Threader Device," which is herein incorporated by reference in its entirety.

FIELD OF THE INVENTION

This invention relates to beauty, skin, and aesthetic care products and, more specifically, to individually attached, disposable threads on thread frames for use with an epilation or threader device.

BACKGROUND OF THE INVENTION

Human hair removal (i.e., epilation) is performed using various types of conventional devices and techniques. Unwanted hair in locations can be extracted partially or entirely (i.e., from the follicle). Using conventional devices and techniques, hair removal is often painful, time-consuming, and performed using skilled technicians, aestheticians, or other personnel. However, conventional epilation devices and techniques are also problematic.

Some conventional devices and techniques use threading as a technique for removing hair. By rolling a length of twisted thread, thin wire, or other filament, hair may be removed and pulled from surrounding skin (i.e., removal by the follicle). This prevents hair from growing back rapidly, if at all. However, threading is time-consuming and requires highly skilled and trained technicians. By requiring highly skilled and trained technicians (e.g., aestheticians), threading is not only time-consuming, but also expensive and manually labor intensive. Moreover, even if a person is familiar with the techniques involved in threading, it is nearly impossible for such person to apply these techniques on himself or herself to remove hair on his or her own body.

The thread pieces used with conventional devices using the threading technique for removing hair, are generally supplied by means of a spool or by hand cutting each thread piece and gluing the pieces down onto cardboard or cutting slits into cardboard to attach each piece of thread onto. This makes it difficult to measure out the exact length of the thread pieces, including the length of thread fibers stretched out, by hand and naked eye. In addition, the user can't avoid touching the threads in the process, which risks contaminating the threads to be used in the threading process. Further, the ends of the thread pieces had to be cut and fell limp at both ends in the slits of the cardboard such that they are not fully stretched out in a straight orientation.

SUMMARY OF THE INVENTION

Given the aforementioned deficiencies of prior art, a need remains for a method and apparatus that includes precisely pre-cut and pre-measured, individually attached, disposable thread pieces built into a frame for use in conjunction with an epilation or threader device.

In one aspect, the present invention provides a method of using individually attached disposable thread pieces from thread frames in conjunction with an epilation or threader device. The inventive method includes providing a first thread frame holding a plurality of individually attached thread pieces of variable length and thickness; providing a second thread frame holding a plurality of individually attached thread pieces of variable length and thickness, wherein the thread pieces of the first frame are of longer than the thread pieces of the second frame; detaching at least one thread piece from the first thread frame and at least one thread piece from the second thread frame and securing each thread piece detached from the respective first and second thread frames onto an epilation or threader device.

In another aspect, the present invention includes an apparatus of a plurality of individually attached, disposable thread pieces secured by a first thread frame and a second thread frame in a straightened orientation for use with an epilation or threader device. The first thread frame includes a plurality of thread pieces of variable length and thickness having a proximal end and a distal end, wherein the proximal end and distal end include beaded ends of a coated material which may be detached from the first thread frame at each beaded end and appropriately secured onto the epilation or threader device. The second thread frame includes a plurality of thread pieces of variable length and thickness having a proximal end and a distal end, wherein the thread pieces of the second thread frame are of a shorter length than the thread pieces of the first thread frame, and wherein the proximal end and distal end include beaded ends of a coated material which may be detached from the second thread frame at each beaded end and appropriately secured onto the epilation or threader device.

These and other features and advantages of this invention will become further apparent from the detailed description and accompanying figures that follow. In the figures and description, numerals indicate the various features of the invention, like numerals referring to like features throughout both the drawings and the description.

Figure 1:
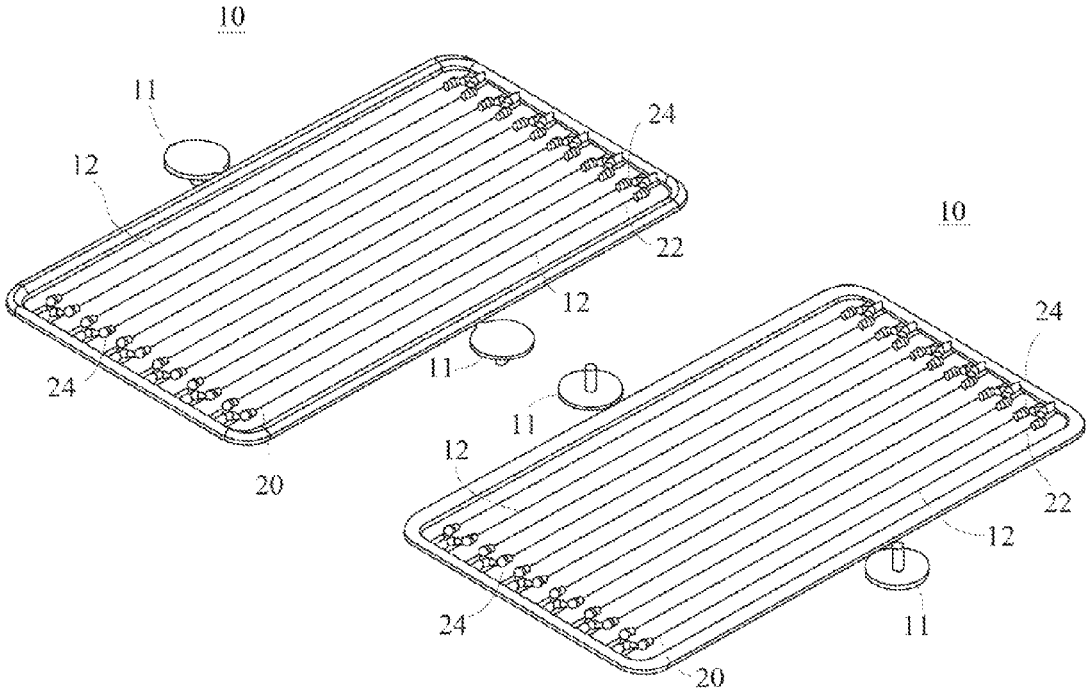
FIG. 1 is a front perspective view of a pair of first thread frames holding the longer thread pieces separately from each other according to the present invention.

One of ordinary skill in the art would appreciate that the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims

DETAILED DESCRIPTION OF THE INVENTION

A primary advantage of the present invention is that when thread pieces are precisely measured down to 0.1 mm, the threads are tight and work efficiently in removing hair from skin when used in conjunction with an epilation or threader device. The individually attached, disposable threads on the thread frames of the present invention are designed to be part of a kit for Epilation Device, U.S. patent application Ser. No. 12/147,367, filed Jun. 26, 2008, which is a Continuation-in-Part of Epilation Device, U.S. patent application Ser. No. 11/986,148, filed Nov. 19, 2007, which claims the benefit of U.S. Provisional Patent Application No. 60/930,360, filed May 15, 2007, which are incorporated by reference in their entireties herein. The individually attached, disposable thread pieces of the thread frames disclosed herein may also be used in conjunction with other conventional epilation or threader devices for the removal of hair from skin.

The present invention concerns a method of using individually attached, disposable thread pieces from thread frames in conjunction with an epilation or threader device. The inventive method includes providing a first thread frame 10 holding a plurality of individually attached thread pieces 12 of variable length and thickness. The method further includes providing a second thread frame 14 holding a plurality of individually attached thread pieces 16 of a variable length and thickness, wherein the thread pieces 12 of the first frame 10 are of a longer length than the thread pieces 16 of the second frame 14. At least one of the longer thread pieces 12 is detached from the first thread frame 10 by pulling beaded end 24 of thread piece 12 away from the first thread frame 10 by hand. Similarly, at least one shorter thread piece 16 is detached from the second thread frame 14 by pulling beaded end 30 of thread piece 16 away from the second thread frame 14 by hand. Each of the thread pieces 12, 16 detached from the respective first and second thread frames 10, 14 may then be secured onto an appropriate epilation or threader device 18 (FIG. 12).

Figure 12:
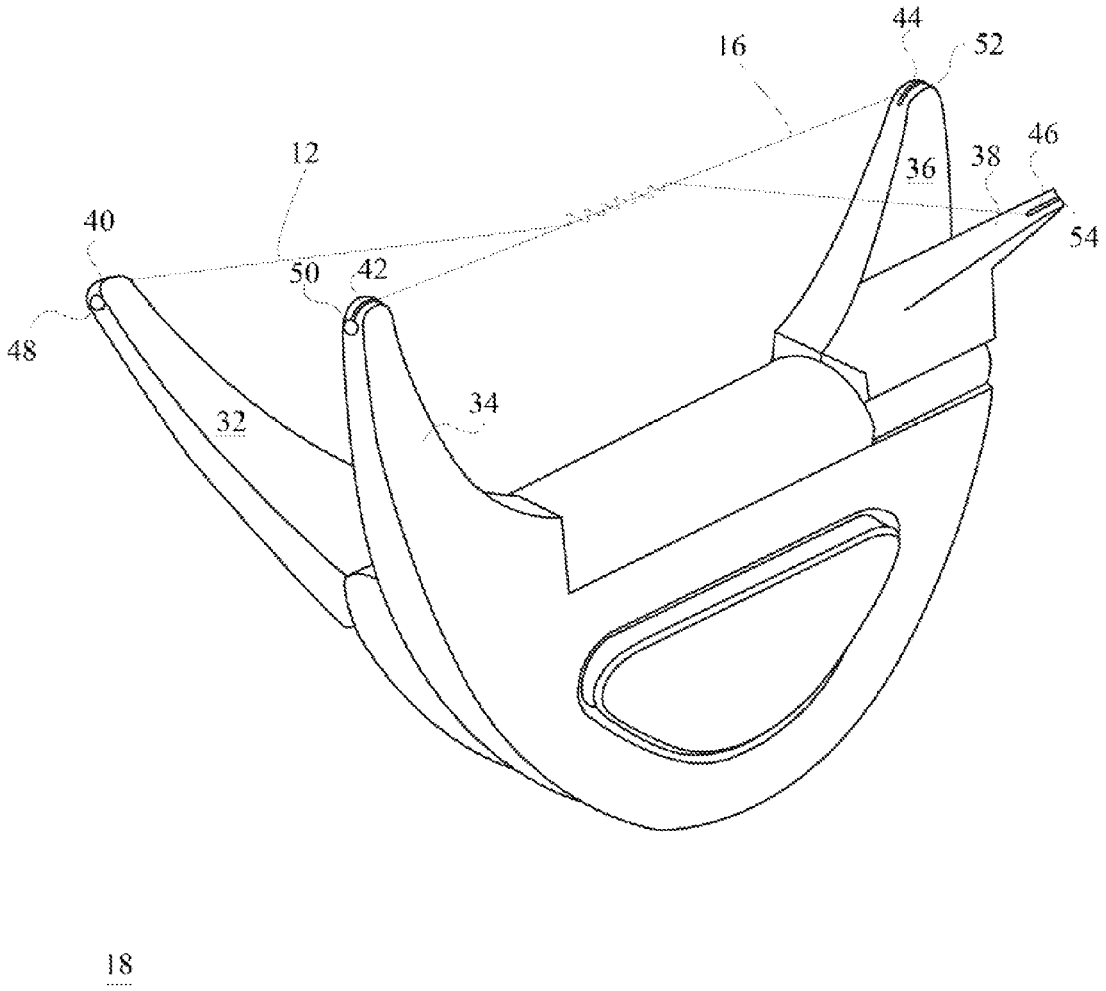
FIG. 12 is a perspective view of a pair of longer thread pieces and a pair of shorter thread pieces detached from their respectively sized first and second thread frames used in conjunction with an exemplary epilation or threader device according to the present invention.

An exemplary epilation device used in accordance with the methods of the present invention is shown in FIG. 12. The epilation device 18 disclosed utilizes two different lengths of thread pieces, namely the longer and shorter thread pieces 12, 16 from the respective first and second thread frames 10, 14. The longer thread piece 12 winds around the shorter thread piece 16 such that each beaded end 24, 30 of both thread pieces 12, 16 is fixed on four arms 32-38 of the epilation device 18. For example, the longer thread piece 12 is secured in a first pair of diagonally opposing arms 32-34 and the shorter thread piece is secured in a second pair of diagonally opposing arms 36-38. This causes the respective thread pieces 12, 16 to be twisted to create an axial twist, coil or twist. The longer and shorter thread pieces 12, 16 may be secured into thread guides 40-46 of the device such that the beaded ends 24, 30 extend beyond thread guides 40-46 and retract at thread receptacles 48-54. Thread receptacles 48-54 may be disposed along an outer surface of arms 32-38 and may be implemented as recessions, depressions, pockets, holes, or receptacles formed at the distal end of arms 32-38.

Figure 2:
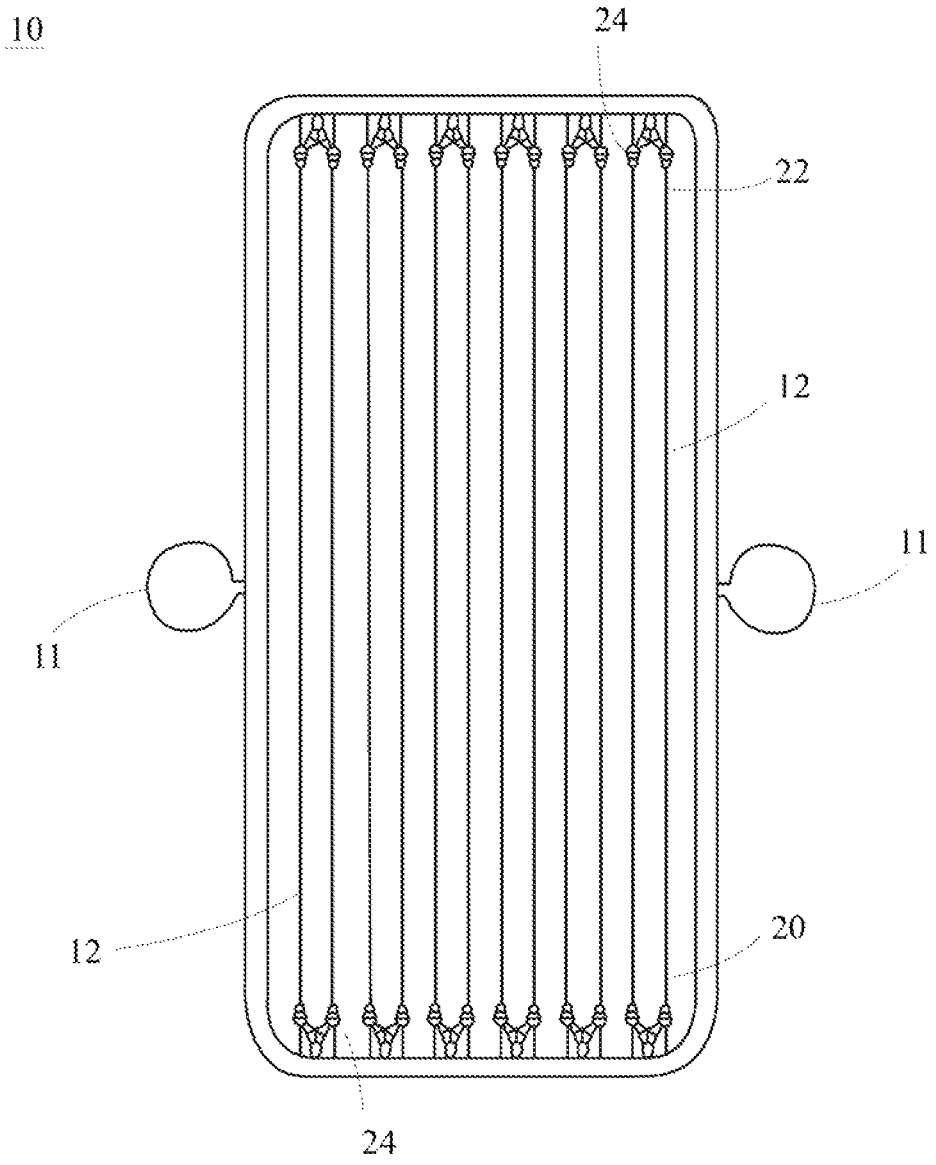
FIG. 2 is a top view of the thread frame of FIG. 1 according to the present invention.

Referring now to FIGS. 1 and 2, an apparatus according to the present invention includes a first thread frame 10 securing a plurality of individually attached, disposable thread pieces 12 of variable length and thickness in a straightened orientation having a proximal end 20 and a distal end 22. The proximal end 20 and distal end 22 include beaded ends 24 of a coated material, which may be detached from the first thread frame 10 at each beaded end 24 by pulling away the beaded end 24 from first thread frame 10 by hand and securing onto an appropriate epilation or threader device 18 (FIG. 12) as previously described herein.

Each first thread frame 10 may be configured to have a clasp device 11 or other similar device attached to each side of the frame 10 in such a manner to enable a pair of first thread frames 10 to be joined or otherwise fitted together and sold as part of a kit for use with an epilation or threader device.

Figure 3:
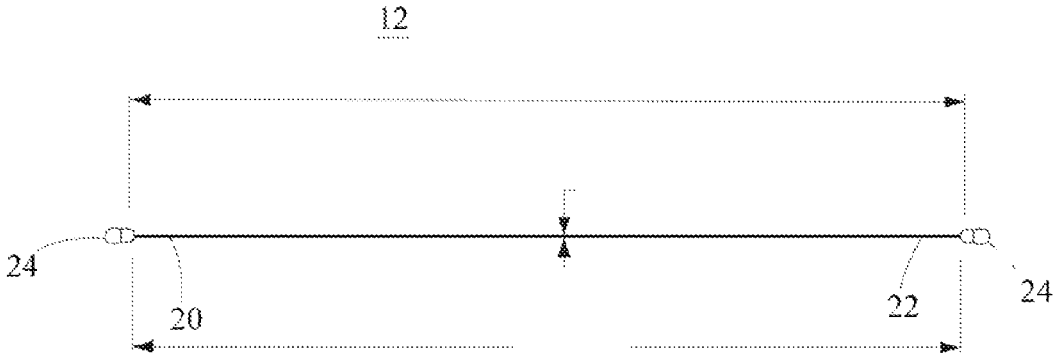
FIG. 3 is a plan view of the longer thread piece shown detached from the thread frame of FIG. 1 according to the present invention.
Figure 4:
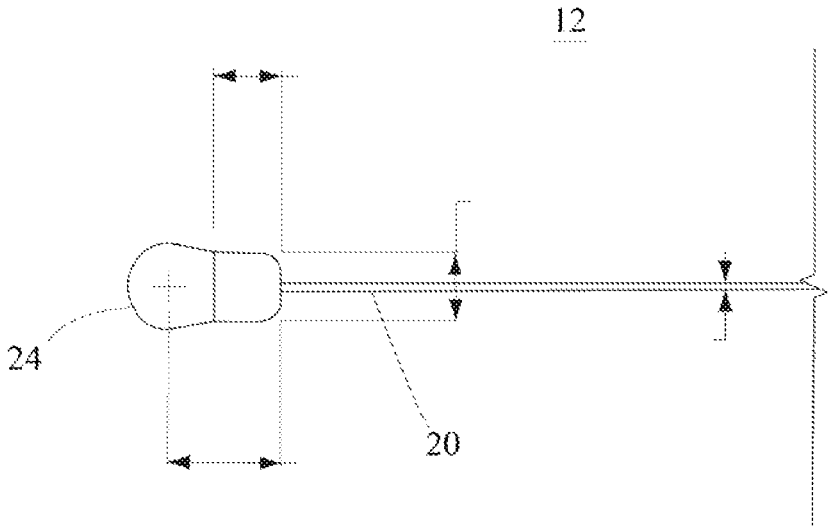
FIG. 4 is an enlarged cut-away view of a proximal end of the longer thread piece of FIG. 3.

FIG. 3 illustrates a plan view of an individual thread piece 12 of variable length and thickness detached from the first thread frame 10 of FIGS. 1 and 2 and suitable for use with an epilation or threader device. FIG. 4 illustrates an enlarged cut-away view of the individual thread piece 12 of FIG. 3 at its proximal end 20.

Figure 5:
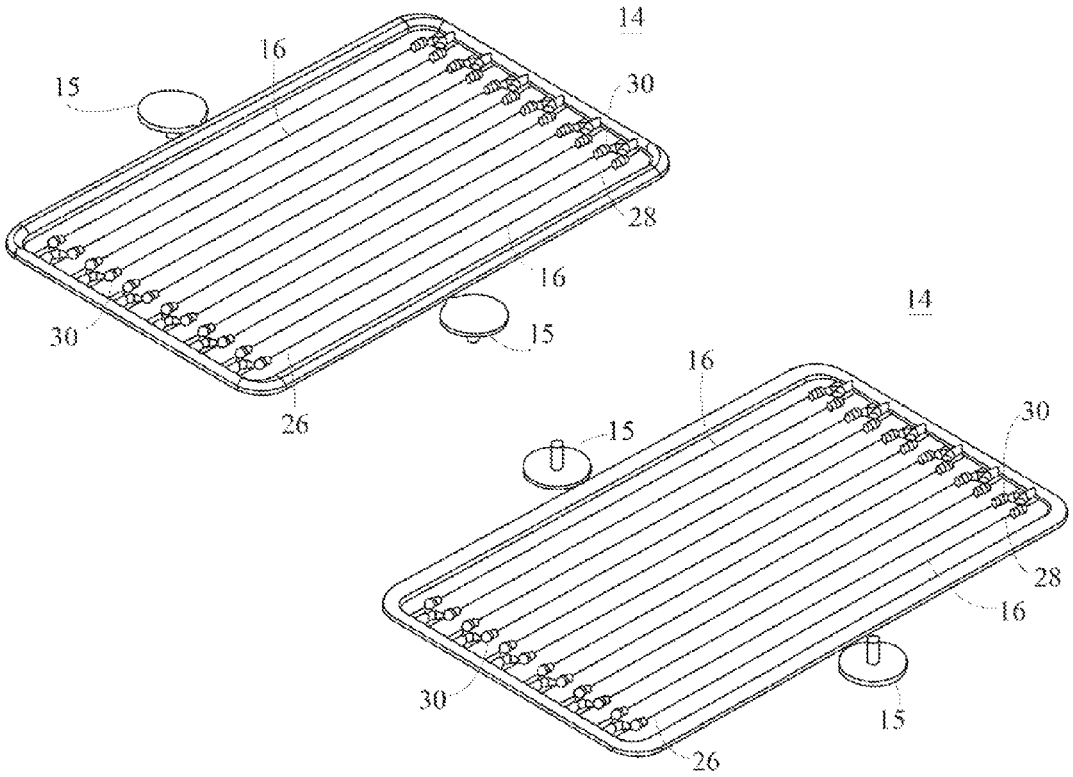
FIG. 5 is a front perspective view of a pair of second thread frames holding the shorter thread pieces separately from each other according to the present invention.
Figure 6:
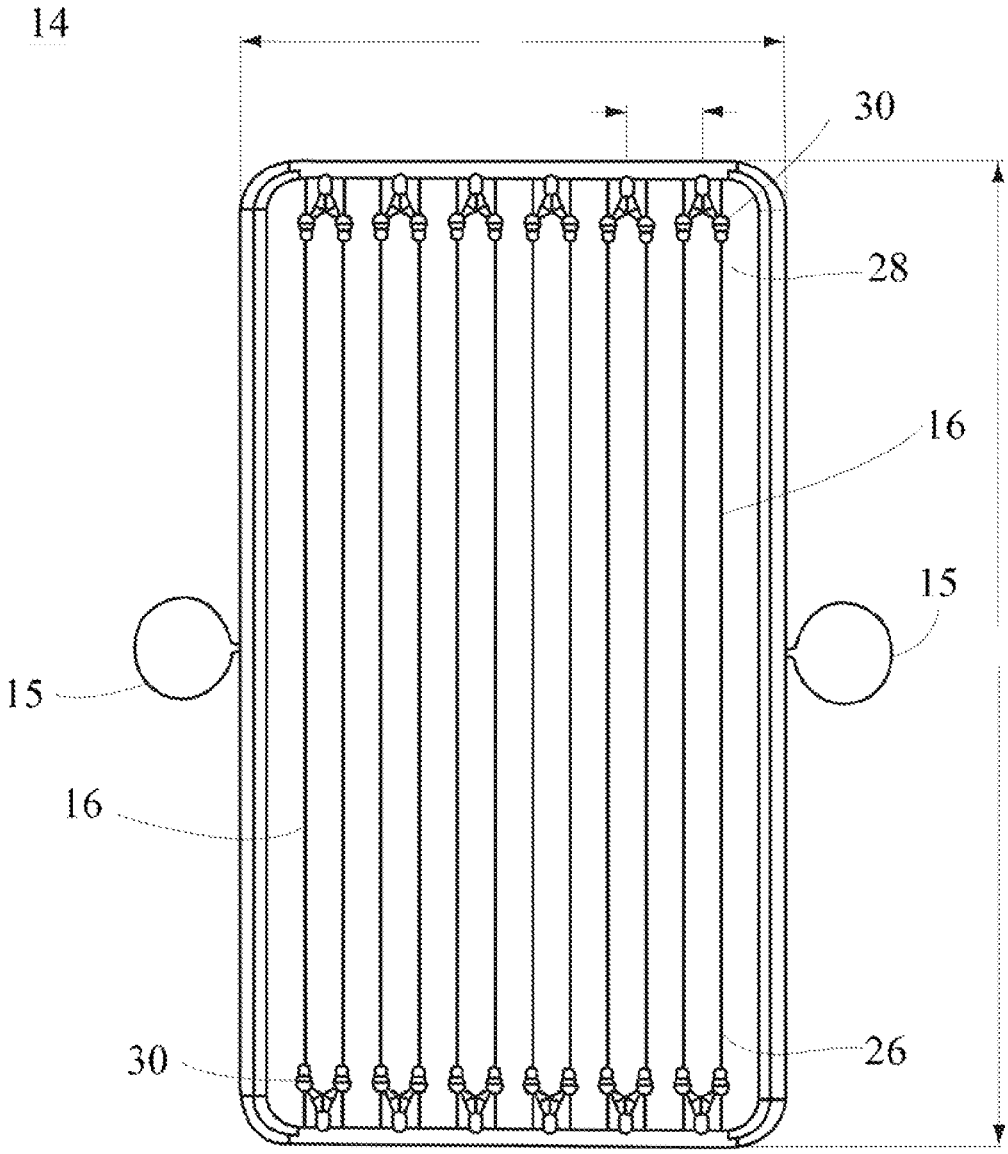
FIG. 6 is a top view of the thread frame of FIG. 5 according to the present invention.

Referring now to FIGS. 5 and 6, the second thread frame 14 includes a plurality of individually attached thread pieces 16 of variable length and thickness having a proximal end 26 and a distal end 28. Thread pieces 16 of the second thread frame 14 are configured to be of shorter length than the thread pieces 12 of the first thread frame 10. The proximal end 26 and distal end 28 include beaded ends 30 of a coated material, which may be detached from second thread frame 14 at each beaded end 30 by pulling away beaded ends 30 from second thread frame 14 by hand and securing onto an appropriate epilation or threader device 18 (FIG. 12) as previously described herein.

Each second thread frame 14 may be configured to have a clasp device 15 or other similar device attached to each side of the frame 14 in such a manner to enable a pair of second thread frames 14 to be joined or otherwise fitted together and sold as part of a kit for use with an epilation or threader device.

Figure 7:
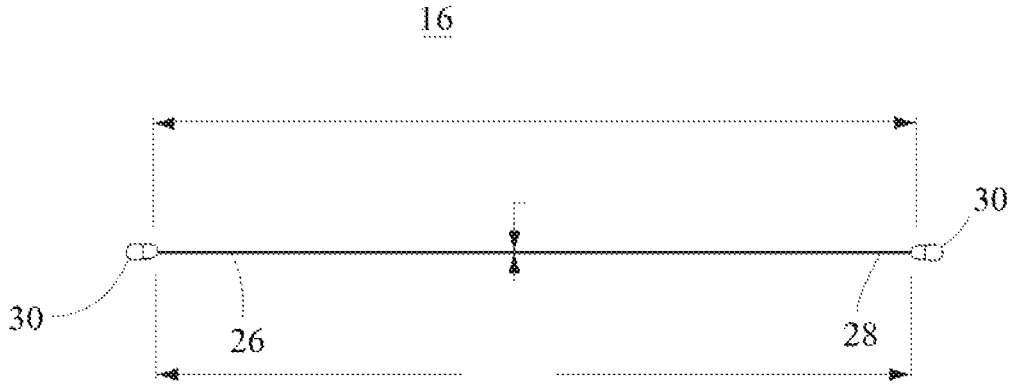
FIG. 7 is a plan view of a shorter thread piece shown detached from the thread frame of FIG. 5 according to the present invention.
Figure 8:
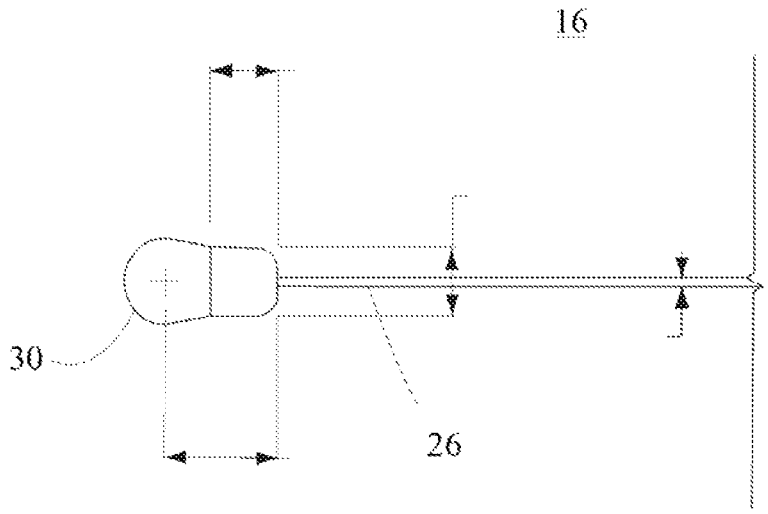
FIG. 8 is an enlarged cut-away view of a proximal end of the shorter thread piece of FIG. 7.

FIG. 7 illustrates a plan view of an individual thread piece 16 of variable length and thickness detached from the second thread frame 14 of FIGS. 5 and 6 and suitable for use with an epilation or threader device. FIG. 8 illustrates an enlarged cut-away view of the individual thread piece 16 of FIG. 7 at its proximal end 26.

Figure 9:
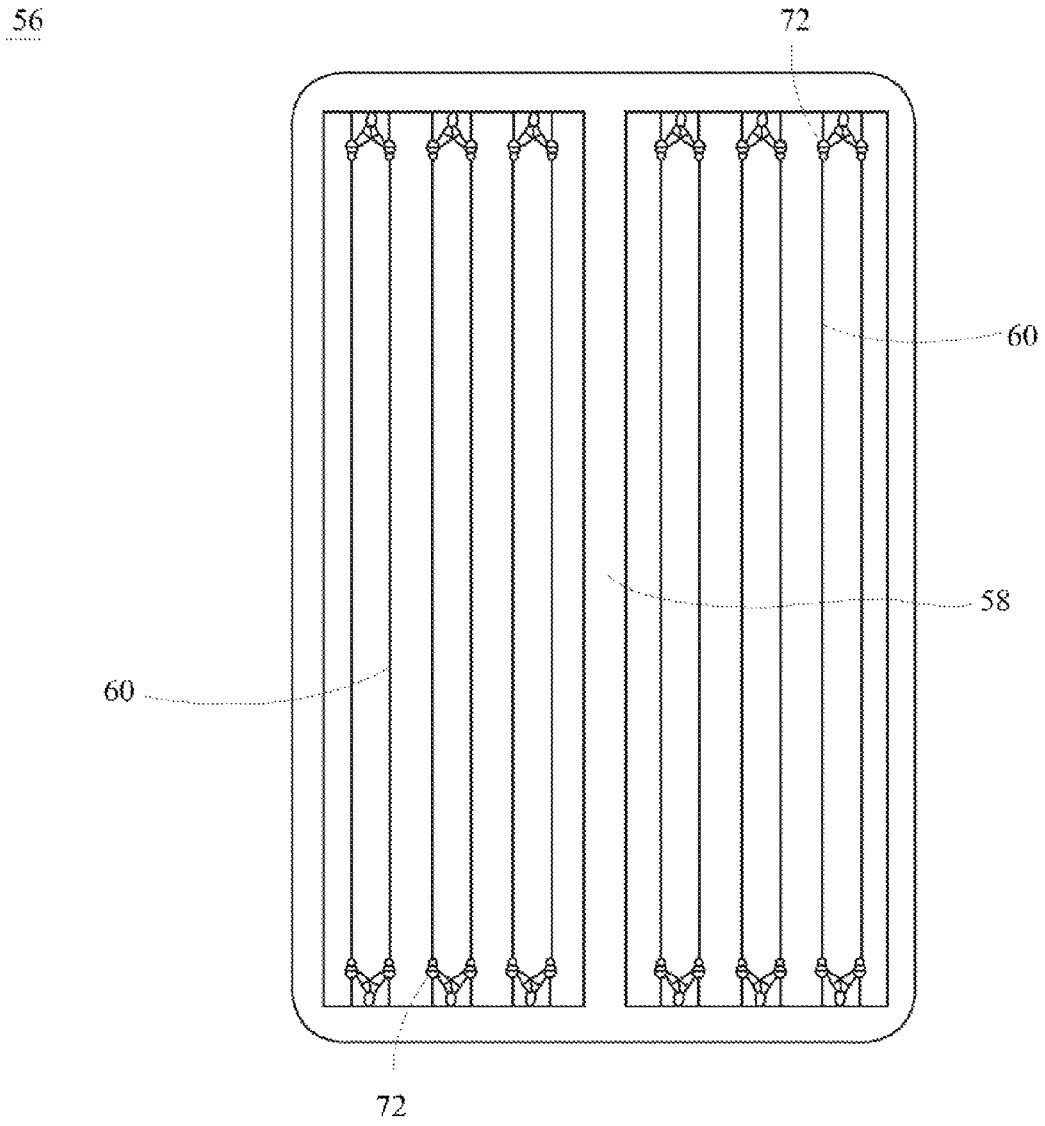
FIG. 9 is a front perspective view of another embodiment of the thread frame of FIG. 1.

Referring now to FIG. 9 is another exemplary embodiment of the first thread frame 10 in accordance with the present invention. In the embodiment illustrated in FIG. 9, first thread frame 56 includes a divider panel 58 configured into center of frame 56 to add further support to frame 56 and to maintain individually attached longer thread pieces 60 in a straightened orientation prior to use in conjunction with an epilation or threader device.

Figure 10:
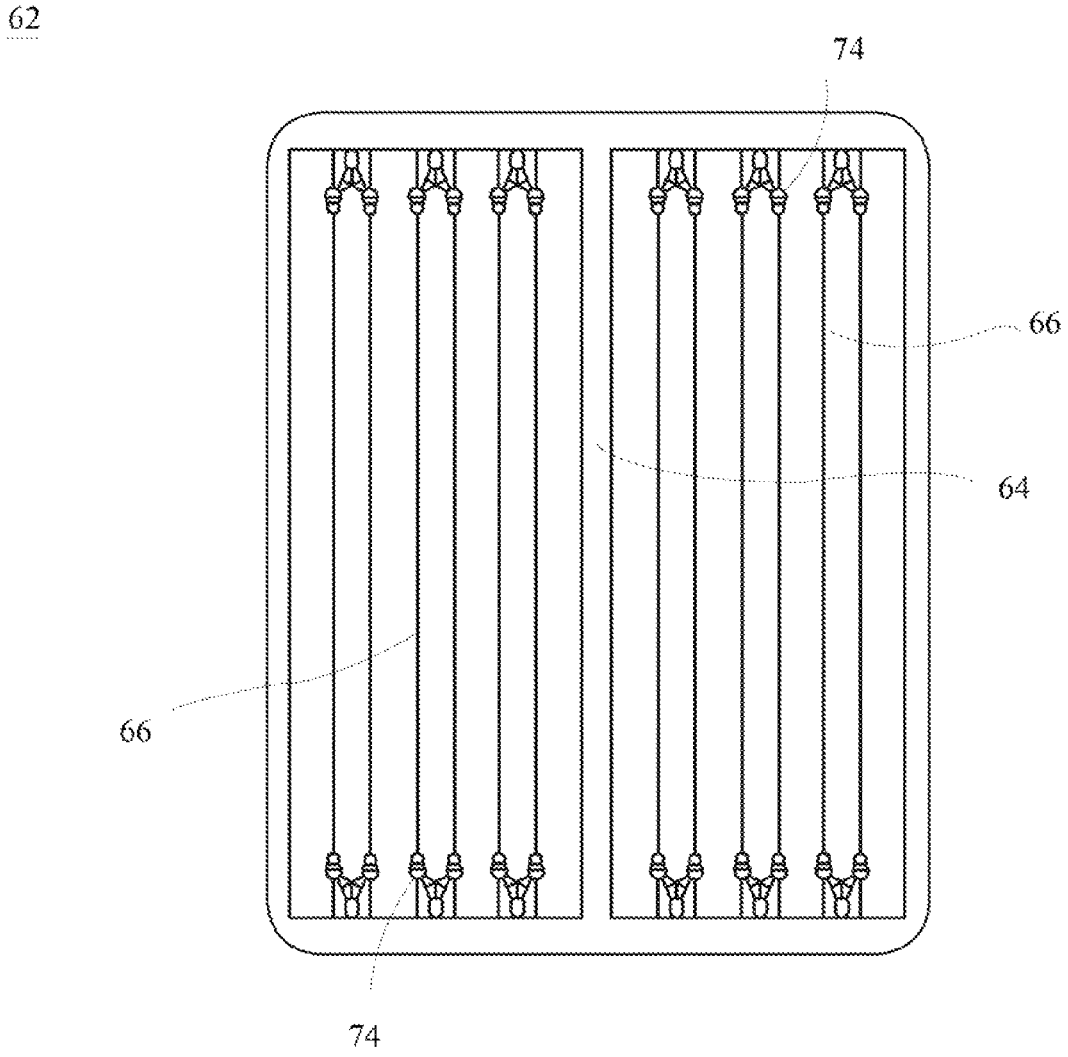
FIG. 10 is a front perspective view of another embodiment of the thread frame of FIG. 5.

FIG. 10 is another exemplary embodiment of the second thread frame 14 in accordance with the present invention. In the embodiment illustrated in FIG. 10, second thread frame 62 includes a divider panel 64 configured into center of frame 62 to add further support to frame 62 and to maintain individually attached shorter thread pieces 66 in a straightened orientation prior to use in conjunction with an epilation or threader device.

Figure 11:
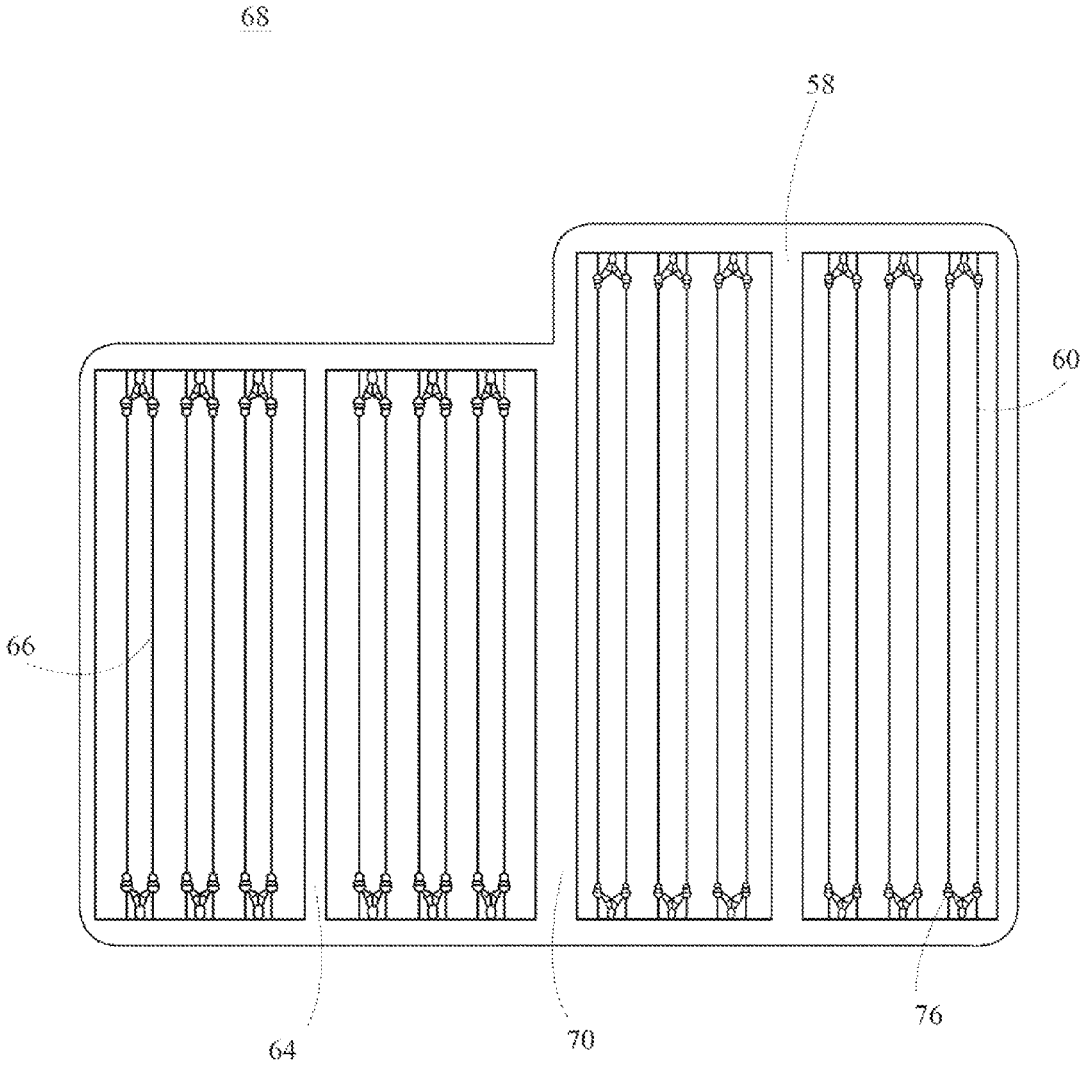
FIG. 11 is a front perspective view of another embodiment of the thread frames of FIGS. 1 and 5.

FIG. 11 illustrates yet another exemplary embodiment of the first and second thread frames 10, 14 in accordance with the present invention. In the embodiment illustrated in FIG. 11, first and second thread frames 10, 14 are combined together into a unitary frame 68 securing both a plurality of individually attached longer and shorter thread pieces 60, 66 in a straightened orientation for use in conjunction with an epilation or threader device. Unitary frame 68 may include a divider panel 70 configured into center of frame 68 to separate the longer thread pieces 60 from the shorter thread pieces 66 and to add further support to frame 68.

The individually attached thread pieces 12, 16, 60, 66 of the respective first and second thread frames 10, 14, 56, 62, 68 used in accordance with the methods of the present invention are intended to be disposable for no further use such that each threading application utilizes a clean pair of thread pieces.

The respective thread lengths, short and long, of the thread pieces 12, 16, 60, 66 may be measured in proportion to one another in a ratio dependent on the length of the diagonals of two sets of arms 32-38 of an epilation device 18 of the type illustrated in FIG. 12. The longer thread piece 12, 60 may wind against the shorter thread piece 16, 66 and both thread pieces are affixed at both ends to the diagonals of each set of arms 32-38 as earlier described herein. The thread guide 40-46 width of each arm 32-28 may be about 2 mm for thread pull through and retraction.

The longer thread piece 12, 60 for the exemplary epilation device illustrated in FIG. 12 may be about 13.7 cm and about 14.5 cm to both ends on the thread frame 10, 56, 68. The first thread frame 10, 56, may have a length of about 15.5 cm and height of the respective frame varies upon the number of thread pieces 12, 60 on each frame. The shorter thread piece 16, 66 for the exemplary epilation device illustrated in FIG. 12 may be about 11.4 cm and 12.2 cm to both ends on the frame. The second thread frame 14, 62 may have a length of about 13.1 cm and height of the respective frame varies upon the number of thread pieces 16, 66 on each frame. The distance or width between the individually attached thread pieces 12, 16, 60, 66 may be about 0.5 cm apart to keep the threads from touching each other on the frames 10, 14, 56, 62, 68.

First and second thread frames 10, 14, 56, 62, 68 may be fabricated from such materials as plastic, metal (i.e., steel, iron, titanium, and the like), wood, alloys, polymers (i.e., polyethylene and copolymers thereof, and the like), composites, or other natural or synthetic materials or combinations thereof. Thread pieces 12, 16, 60, 66 of the respective first and second thread frames 10, 14, 56, 62, 68 may be fabricated from such materials as cotton, nylon, wool, steel, wire, or other thin natural or synthetic filaments suitable for epilation. Beaded ends 24, 30, 72, 74, 76 of the longer and shorter thread pieces 12, 16, 60, 66 may be fabricated from such coated materials as metal (i.e., steel, iron, titanium, and the like), wood, plastic, alloys, polymers (i.e., polyethylene and copolymers thereof, and the like), composites, or other natural or synthetic materials or combinations thereof.

The first and second thread frames 10, 14, 56, 62, 68 may be formed by injection molding with an appropriate material disclosed above such that the injected material (i.e., plastic) runs along a mold embedding the thread pieces 12, 16, 60, 66 into both the mold for the beaded ends 24, 30, 72, 74, 76 and through the respective frames themselves. The injection molding process starts from the middle of the frame, which is also an injection piece, such as plastic, connected to the rest of the frame. This is how the injection material flows through the mold to form the thread frame. Otherwise, if the thickness of the frame is too thin, and not deep enough, the plastic injection will harden and not be fluid enough to form the entire frame to enclose the threads.

What is claimed is:

1. A device for securing thread pieces in a substantially straightened orientation comprising:

a thread frame holding a set of individually attached thread pieces with each thread piece having two ends, each thread piece attached to the frame at the two ends thereof and being detachable from the thread frame at the end, and a bead attached to the thread near each end of the thread, leaving a portion of the thread between the bead and the end of the thread for attaching the end of the thread to the frame, wherein the ends of the thread are detachable from the frame, and the thread with the beads is used in a device for removing hair;

wherein the beads are detachably attached to the frame, and wherein two beads on two separate threads are detachably attached to the frame via an extension from the frame.

2. The device of claim 1, further comprising in addition to a first thread frame a second thread frame holding a second set of individually attached thread pieces at the two ends thereof and being detachable from the second thread frame at the ends; wherein the first and second sets of thread pieces are of variable length and thickness.

3. The device of claim 1, wherein the beaded ends are made of one of the following coated materials:

metal;
wood;
plastic;
alloys;
polymers; and
composites.

4. The device of claim 1, further comprises a first divider panel configured into the thread frame, the first divider panel separating the set of thread pieces there between.

5. The device of claim 2, further comprises a second divider panel configured into the second thread frame, the second divider panel separating the second set of thread pieces there between.

6. The device of claim 2, wherein the first and second thread frame are consolidated into one unitary frame for securing the first and second sets of thread pieces thereto.

7. The device of claim 6, wherein the unitary frame includes a divider panel configured into the frame, the divider panel separating the first set of thread pieces from the second set of the thread pieces.

8. The device of claim 1, wherein the set of thread pieces are approximately 13.7 cm-14.5 cm long.

9. The device of claim 1, wherein the thread frame is approximately 15.5 cm long.

10. The device of claim 2, wherein the second set of thread pieces are approximately 11.4 cm-12.2 cm long.

11. The device of claim 2, wherein the second thread frame is approximately 13.1 cm long.

12. The device of claim 1, wherein each thread piece is approximately 0.5 cm apart from one another.

13. The device of claim 1, wherein the frame is fabricated from one of the following materials:

plastic;
metal;
wood; alloys;
polymers; and
composites.

14. The device of claim 1, wherein the thread pieces are fabricated from one of the following materials:

cotton;

nylon;

wool;

steel; and wire.

15. The device of claim 1, wherein the frame-is formed by injection molding with an appropriate material that runs along a mold embedding the first and second sets of thread pieces into the mold for the beaded ends and through the respective frames.

* * * * *